US006680643B2

(12) United States Patent
Conte et al.

(10) Patent No.: US 6,680,643 B2
(45) Date of Patent: Jan. 20, 2004

(54) BANDGAP TYPE REFERENCE VOLTAGE SOURCE WITH LOW SUPPLY VOLTAGE

(75) Inventors: Antonino Conte, Tremestieri Etneo (IT); Oreste Concepito, Palermo (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 10/060,870

(22) Filed: Jan. 30, 2002

(65) Prior Publication Data

US 2002/0158682 A1 Oct. 31, 2002

(30) Foreign Application Priority Data

Jan. 31, 2001 (EP) ..... 01830059

(51) Int. Cl.[7] ..... G05F 1/10; G05F 3/02
(52) U.S. Cl. ..... 327/539
(58) Field of Search ..... 327/539; 323/313, 323/314

(56) References Cited

U.S. PATENT DOCUMENTS

| | | | | |
|---|---|---|---|---|
| 5,394,026 A | | 2/1995 | Yu et al. | 327/536 |
| 5,568,045 A | * | 10/1996 | Koazechi | 323/314 |
| 6,028,482 A | | 2/2000 | Herrle | 330/282 |
| 6,147,548 A | | 11/2000 | Doyle | 327/539 |

FOREIGN PATENT DOCUMENTS

EP 0 598 578 A2 5/1994

OTHER PUBLICATIONS

Jiang et al., A 1.2 V Bandgap Reference Based on Transimpedance Amplifier, IEEE International Symposium on Circuits and Systems, May 28–31, 2000, Geneva, Switzerland.*

* cited by examiner

*Primary Examiner*—Terry D. Cunningham
*Assistant Examiner*—Quan Tra
(74) *Attorney, Agent, or Firm*—Lisa K. Jorgenson; Harold H. Bennett, II; Seed IP Law Group PLLC

(57) ABSTRACT

Bandgap type reference voltage source using an operational transimpedance amplifier. The bandgap stage is formed by a first and a second bandgap branch parallel-connected; the first bandgap branch comprises a first diode and a transistor, series-connected and forming a first output node; the second bandgap branch comprises a second diode and a second transistor series-connected and forming a second output node. The operational amplifier has inputs connected to the output nodes of the bandgap stage. An amplifier current detecting stage is connected to the outputs of the operational amplifier and supplies a current related to the current drawn by the operational amplifier. A diode current detecting stage is connected to the output of the amplifier current detecting stage and to an output of the operational amplifier and supplies a current related to the current flowing in the first diode. An output stage transforms this current into a stabilized voltage.

11 Claims, 5 Drawing Sheets

BANDGAP TYPE REFERENCE VOLTAGE SOURCE WITH LOW SUPPLY VOLTAGE

BACKGROUND OF THE INVENTION

1. Field of the Invention

The present invention relates to a bandgap type reference voltage source with low supply voltage.

2. Description of the Related Art

In most electronic devices with a high integration scale, there are analogue blocks which require a reference voltage that is independent of the temperature and of the supply voltage. Examples of these electronic devices are voltage regulators for programming and erasing non volatile memories and DC/DC voltage reduction converters which generate internal supply voltages regulated at a fixed value.

The generation of reference voltages is generally obtained through a source circuit which supplies a bandgap output voltage.

Various bandgap reference sources are known. The simplest is formed by bipolar transistors, present in standard CMOS technology, of a vertical type, as shown in FIG. 1.

The bandgap source 1 of FIG. 1 comprises a bandgap stage 18, an operational amplifier 15 of transconductance type, and an output stage 19.

The bandgap stage 18 comprises a first and second branch 2, 3 flowed by a first and a second current $I_1$, $I_2$. The first branch 2 is formed by a first PMOS transistor 5 and by a first diode connected bipolar transistor, shown in FIG. 1 as a diode 6; the second branch 3 is formed by a second PMOS transistor 7, by a first resistor 8 and by a second diode 9. The PMOS transistors 5, 7 are identical, have source terminals connected to a supply line 12, and drain terminals connected to a first and, respectively, to a second output node 10, 11. The output nodes 10, 11 are set respectively at voltages $V_A$, and $V_B$. The first output node 10 is connected to an anode terminal of the first diode 6; the second output node 11 is connected to an anode terminal of the second diode 9 through the first resistor 8. The diodes 6, 9 have an area ratio 1:n and have their cathodes connected to ground 16. The first resistor 8 has a resistance $R_1$.

The operational amplifier 15 has an inverting input connected to the first output node 10, a non-inverting input connected to the second output node 11 of the bandgap stage 18 and an output connected to the gate terminals of the PMOS transistors 5, 7.

The output stage 19 comprises a PMOS output transistor 20, an output resistor 21 and an output diode 22. The PMOS output transistor 20 is equal to the first and second PMOS transistors 5, 7 (and thus it is formed using the same technology and has the same dimensions as the transistors 5, 7) and has source terminal connected to the supply line 12, gate terminal connected to the output of the operational amplifier 15, and drain terminal defining an output terminal 24 on which there is a bandgap voltage $V_{BG}$. The output terminal 24 is connected, through the output resistor 21, to the anode of the output diode 22, the cathode of which is connected to ground 16. The output resistor 21 has a resistance $R_2$; on the output diode 22 there is a voltage $V_D$ and in the output stage 19 flows a current $I_3$.

Since the PMOS transistors 5, 7 are identical and have the same gate-to-source voltage $V_{gs}$, this gives:

$$I_1=I_2,$$

moreover the operational amplifier 15 maintains $V_A=V_B$.

When the equations of the dipole 13 formed by the first diode 6 and of the dipole 14 formed by the resistor 8 and by the second diode 9 are written, the conditions of equality of current and voltage indicated above occur only when:

$$I_1=I_2=(V_T/R_1)\ln(n). \tag{1}$$

Moreover, as the PMOS output transistor 20 is identical and has the same gate-to-source voltage $V_{gs}$ as the first and the second PMOS transistor 5, 7, it conducts a current $I_3=I_1=I_2$.

Consequently, in the PMOS transistors 5, 7, 20 there flows a current proportional to $V_T/R$. The bandgap voltage $V_{BG}$ present on the output terminal 24 is therefore equal to:

$$V_{BG}=V_D+I_3{}^{*}\ R_2=V_D+K(V_T/R_1)R_2 \tag{2}$$

In (2), the resistance ratio $R_2/R_1$ is insensitive to temperature variations, since the two resistors 8, 21 vary in the same way; vice versa the terms $V_T$ and $V_D$ are variable with temperature. However, by acting on the coefficient K (through the mirroring ratio n) and on the number of diodes in parallel, it is possible to ensure that the temperature variations of $V_T$ and $V_D$ are compensated and that the bandgap voltage $V_{BG}$ present on the output terminal 24 is substantially insensitive to temperature.

The circuit in FIG. 1, however, has the problem that the inputs of the operational amplifier 15 have a temperature dynamics of 300 mV (−2 mV/° C.) and consequently, when the power supply falls below 1.5 V, the operational amplifier 15 does not work correctly. In fact, on the outputs of the operational amplifier 15 there are transistors (whether of the N-type or the P-type) which, at least in certain temperature intervals, work below threshold.

Moreover the bandgap voltage $V_{BG}$ generated by the output stage 19 is equal to about 1.25 V, so the supply voltage must be kept above 1.5 V.

Another known bandgap type reference source uses NMOS transistors operating below threshold instead of the first and the second diode 6, 9. This solution solves the problem of operation at a low supply voltage as regards the bandgap stage, but it suffers from other problems. In fact its PSSR value (Power Supply Rejection ratio) in DC is not very high; consequently, a supply voltage decrease leads to an unacceptable variation of the output voltage. Moreover, in a dynamic condition, the rejection of the noise coming from the power supply is not very good. Finally, also this solution uses an output stage similar to that of FIG. 1, so it is affected by the same problem of limitation of the minimum usable power supply voltage.

BRIEF SUMMARY OF THE INVENTION

An embodiment of the invention solves the problems affecting the known bandgap reference sources.

According to an embodiment of the present invention a bandgap type reference voltage source and a method for generating a reference voltage in a bandgap type reference voltage source are provided.

A bandgap type reference voltage source using an operational transimpedance amplifier is provided. The bandgap stage is formed by a first and a second bandgap branch, parallel-connected. The first bandgap branch comprises a first diode and a transistor, series-connected and forming a first output node; the second bandgap branch comprises a second diode and a second transistor series-connected and forming a second output node. The operational transimpedance amplifier has inputs connected to the output nodes of the bandgap stage. An amplifier current detecting stage is connected to the outputs of the operational amplifier and supplies a current related to the current drawn by the operational amplifier. A diode current detecting stage is connected to the output of the amplifier current detecting stage and to an output of the operational amplifier and supplies a current related to the current flowing in the first diode. An output stage transforms this current into a stabilized voltage.

A method of operation is also provided.

BRIEF DESCRIPTION OF THE SEVERAL VIEWS OF THE DRAWING(S)

To allow understanding of the present invention, a preferred embodiment is now described, purely as a non-limitative example, with reference to the enclosed drawings, wherein.

DETAILED DESCRIPTION OF THE INVENTION

Figure 2:
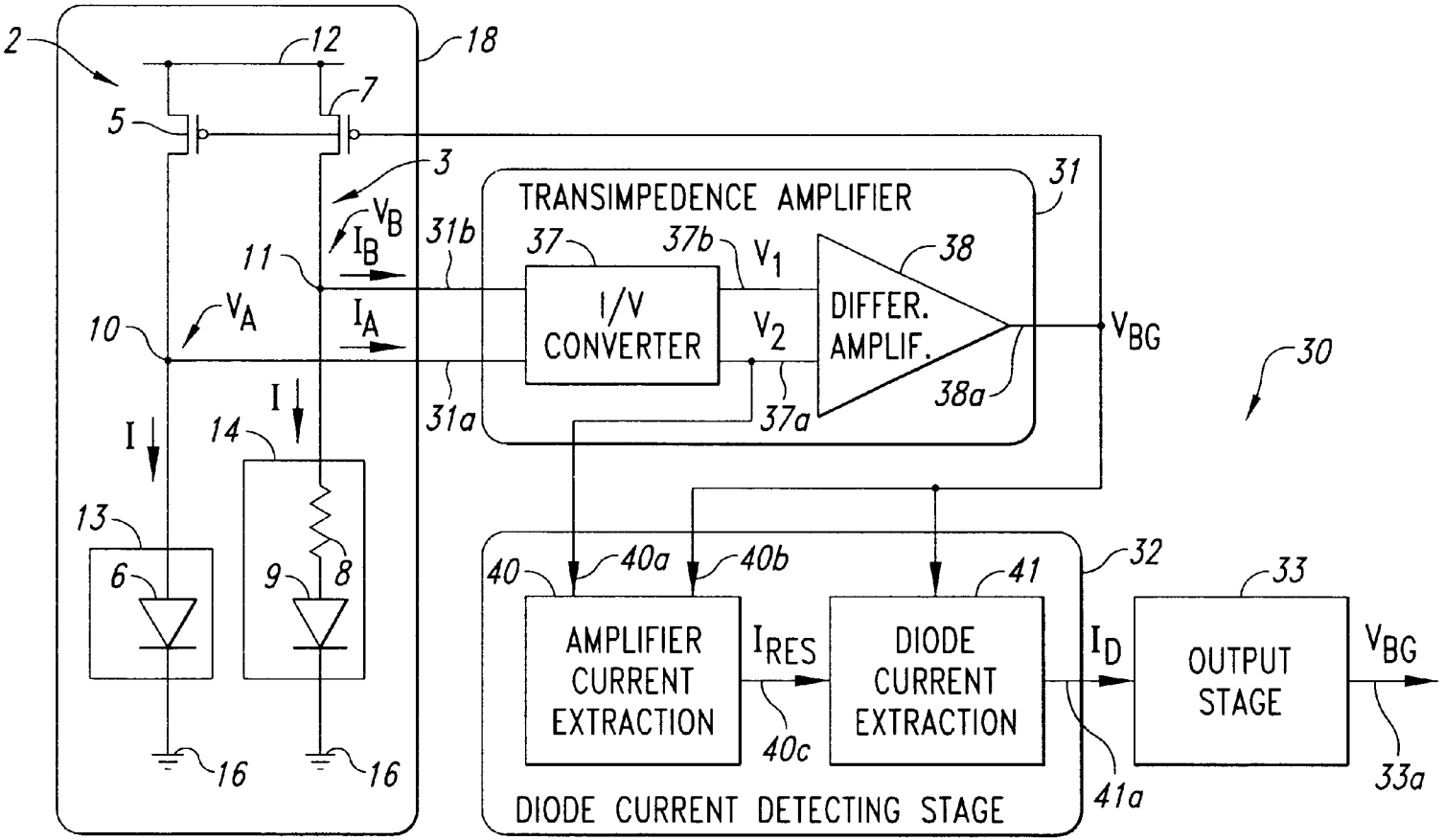
FIG. 2 shows a block diagram of a reference source according to the invention.

FIG. 2 shows a block diagram of a reference source 30, of bandgap type, according to the invention. The reference source 30 comprises a bandgap stage 18, an operational transimpedance amplifier 31, a diode current detecting stage 32, and an output stage 33.

Figure 1:
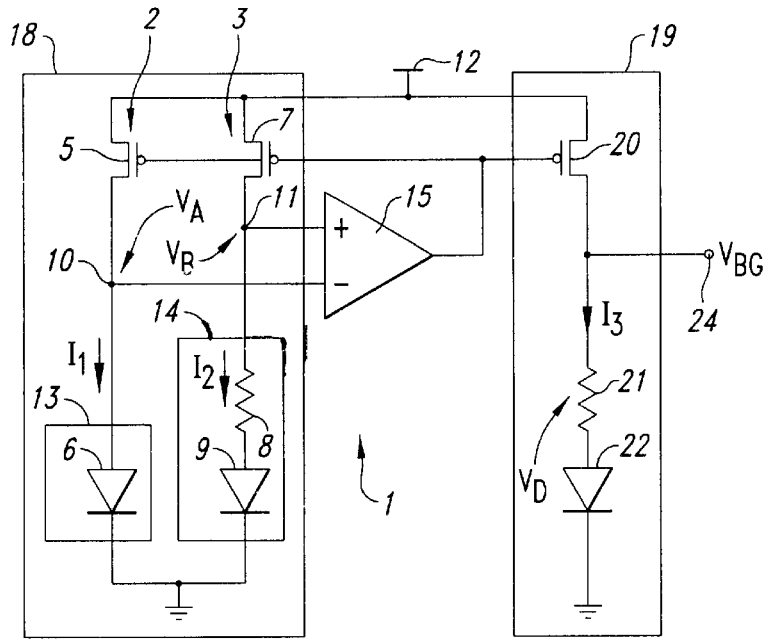
Fig. 1 (Prior Art)
FIG. 1 shows a circuit diagram of a known bandgap type reference voltage source.

The bandgap stage 18 is equal to that of FIG. 1; consequently its components have been given the same reference numbers and will not be further described. In particular, it is stressed that the first and the second diodes 6, 9 may be implemented through bipolar NPN transistors having the respective base and collector terminals connected together.

The operational transimpedance amplifier 31, unlike the operational amplifier 15 of FIG. 1 which has voltage inputs, has a first and a second current inputs 31*a*, 31*b* receiving respectively a first and a second input currents $I_A$, $I_B$. The operational transimpedance amplifier 31 is formed by two cascade-connected stages: a current/voltage converter 37, receiving the input currents $I_A$, $I_B$ on the current inputs 31*a*, 31*b* and supplying, on a first and, respectively, a second outputs 37*a*, 37*b*, a first and second intermediate voltages $V_1$, $V_2$ functions of the input currents $I_A$, $I_B$; and a differential amplifier 38 having inputs connected to the outputs 37*a*, 37*b* of the current/voltage converter 37 and an output 38*a* supplying an output voltage $V_{OUT}$ to the gate terminals of the PMOS transistors 5, 7.

The diode current detecting stage 32 is formed, in turn, by an amplifier current extraction block 40 and by a diode current extraction block 41, cascade-connected. In detail, the amplifier current extraction block 40 has a first and a second inputs 40*a*, 40*b*, connected to the first output 37*a* of the current/voltage converter 37 and, respectively, to the output 38*a* of the differential amplifier 38, and an output 40*c* connected to an input of the diode current extraction block 41.

The diode current extraction block 41 has an output 41*a* supplying a current $I_D$ and connected to an input of the output stage 33 which, in turn, has an output 33*a* supplying the bandgap voltage $V_{BG}$.

In the reference source 30 of FIG. 2, due to the equality of the currents and voltages of dipoles 13, 14, the current I is still proportional to $V_T/R_1$, according to (1); however the operational transimpedance amplifier 31 draws an input current $I_A$ from the first output node 10 and an input current $I_B$ from the second output node 11 of the bandgap stage 18 (in which, at equilibrium, the input currents $I_A$, $I_B$ are the same). This means that the current $I_{PMOS}$ provided by the PMOS transistors 5, 7 is no longer equal to, but is greater than the current I flowing in the diodes 6, 9, because of the input current $I_A$, $I_B$, drawn by the operational transimpedance amplifier 31; consequently the output voltage $V_{OUT}$ is a function of the sum of the current I flowing in the diodes and the input current $I_A$, $I_B$ drawn by the operational transimpedance amplifier 31.

Figure 4:
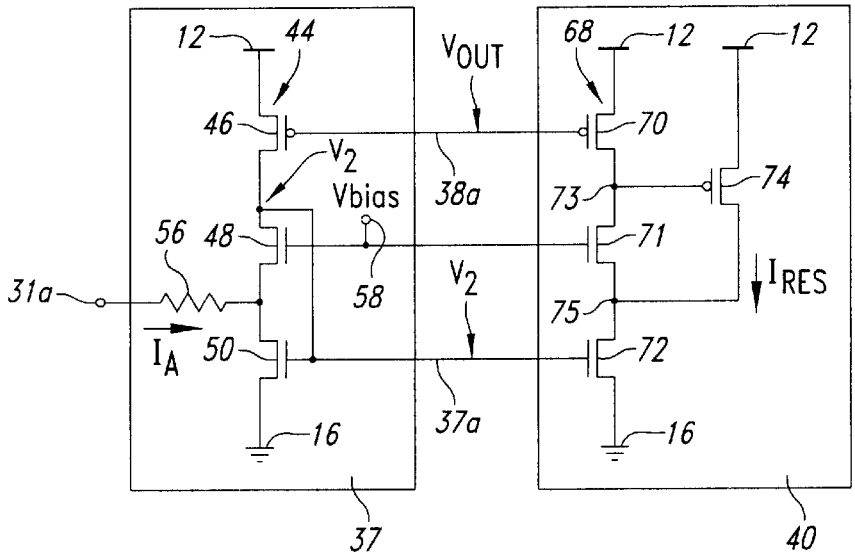

To eliminate from the current $I_{PMOS}$ provided by the PMOS transistors 5, 7 the contribution due to the input current $I_A$, $I_B$ drawn by the operational transimpedance amplifier 31, the amplifier current extraction block 40 acquires the intermediate voltage $V_2$ at output 37*a* of the current/voltage converter 37, which is correlated to the input current $I_A$ drawn at the current input 31*a*, and the output voltage $V_{OUT}$ and supplies a current output $I_{RES}$ proportional (in the specific example equal, as demonstrated below with reference to FIG. 4) to the input current $I_A$ drawn at the current input 31*a*.

Thereby, the diode current extraction block 41, on the basis of the output voltage $V_{OUT}$ of the operational transimpedance amplifier 31 (function of the current $I_{PMOS}$ flowing in the PMOS transistors 5, 7) and of the current $I_{RES}$ supplied by the amplifier current extraction block 40, calculates a current $I_D$ proportional (in the specific example equal) to the current I flowing in the first diode 6 of the first branch 2 and supplies it to the output stage 33 which converts it into the bandgap voltage $V_{BG}$.

The same results could be obtained by detecting the current $I_B$ flowing in the second input 31*b* of the operational transimpedance amplifier 31.

Below is a description of the structure and operation of the different blocks of FIG. 2, with reference to FIGS. 3–6.

Figure 3:
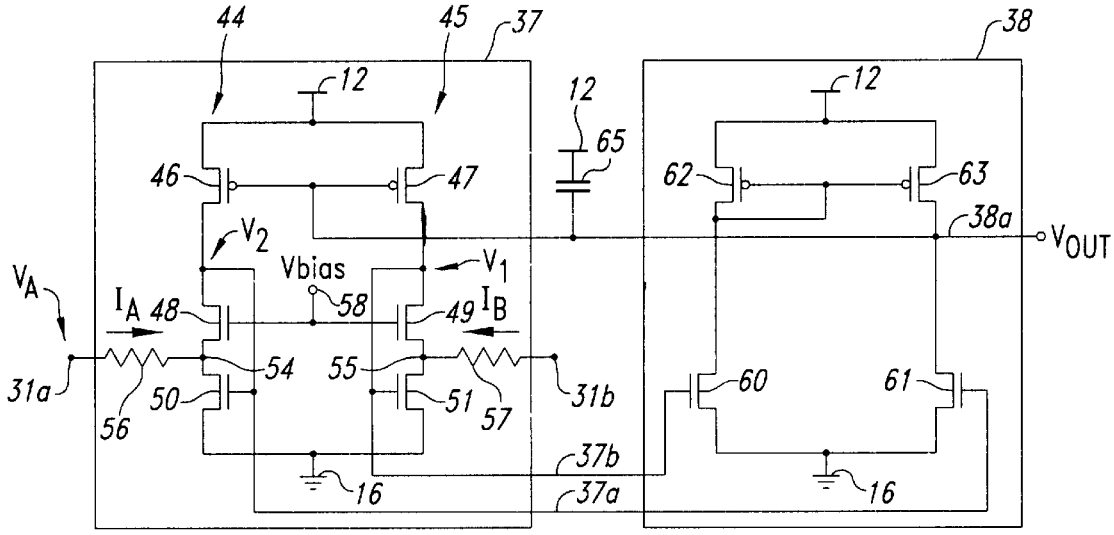
FIGS. 3–6 show detailed circuit diagrams of blocks of the reference source in FIG. 2.

The structure of the transimpedance amplifier 41 is shown in FIG. 3. In detail, the current/voltage converter 37 comprises a first and a second converter branches 44, respectively 45, symmetrical and formed by a load transistor 46, respectively 47, of PMOS type, a cascode transistor 48, respectively 49, of NMOS type, an input transistor 50, respectively 51, and an input resistor 56, respectively 57, series-connected between the power supply line 12 and the ground 16. The load transistors 46, respectively 47, cascode transistors 48, respectively 49, input transistors 50, respectively 51 of the first, respectively second converter branch 44, 45, are series-connected between the power supply line 12 and the ground 16. The gate terminals of the load transistors 46, 47 are connected together and to the output 38*a* of the differential amplifier 38. An intermediate node between the drain terminal of the load transistor 46, respectively 47 and the drain terminal of the cascode transistor 48, respectively 49 is connected to the gate terminal of the input transistor 50, respectively 51 and forms the first output 37*a*, respectively the second output 37*b* of the current/voltage converter 37. An input node 54 between the source terminal of the cascode transistor 48 and the drain terminal of the input transistor 50 of the first converter branch 44 is connected to the first current input 31*a* through the first resistor 56; an input node 55 between the source terminal of the cascode transistor 49 and the drain terminal of the input transistor 51 of the second converter branch 45 is connected to the second current input 31*b* through the input resistor 57. Moreover, the gate terminals of both the cascode transistors 48, 49 are connected to a bias node 58 set at a bias voltage $V_{bias}$ obtained from the output voltage $V_{OUT}$ through a circuit not shown. The bias voltage $V_{bias}$ is therefore stable in temperature.

The outputs 37*a*, 37*b* of the current/voltage converter 37 are connected to gate terminals of NMOS transistors 60, 61 belonging to the differential amplifier 38 and having source terminals connected to ground 16 and drain terminals connected to a respective PMOS transistor 62, 63. The PMOS transistors 62, 63 of the differential amplifier 38 are connected as a current mirror; in particular, the PMOS transistor 62 is diode-connected and has drain and gate terminals connected together. The node between the PMOS transistor 63 and the NMOS transistor 61 is connected to output 38*a* of the differential amplifier 38.

A capacitor 65 is connected between output 38*a* of the differential amplifier 38 and the supply line 12 and has the aim of improving the PSRR.

The bias node 58 is kept at a low bias voltage $V_{bias}$, for example 800 mV; consequently, the input nodes 54 and 55 are biased at a lower voltage, linked to the gate-source voltage of the input transistors 49, 51, and 48, 50, for example 300 mV. As a result, the potential on the current inputs 31*a* and 31*b* may reach low values, as far as the voltage of the input nodes 54, 55 (in the example considered, 300 mV). From the above, it is clear that the use of a transimpedance amplifier allows the correct operation of the source in the whole temperature interval allowed by the technology used, without any components working in incorrect conditions within this interval.

The structure of the amplifier current extraction block 40 is shown in FIG. 4, wherein, to simplify the understanding of its operation, the first converter branch 44 of the current/voltage converter 37 has been reproduced.

In detail, the amplifier current extraction block 40 comprises a current extraction branch 68 which has substantially the structure of the first converter branch 44 and therefore comprises a first PMOS transistor 70, a cascode transistor 71, of NMOS type, and a NMOS transistor 72 series-connected between the supply line 12 and ground 16. The PMOS transistor 70 has source terminal connected to the supply line, gate terminal connected to output 38*a* of the differential amplifier 38 and drain terminal connected to the drain terminal of the cascode transistor 71 at a first node 73. The cascode transistor 71 has gate terminal connected to the bias node 58 and source terminal connected to the drain terminal of the NMOS transistor 72 at a second node 75.

A current extraction transistor 74, of PMOS type, has source terminal connected to the supply line 12, gate terminal connected to the first node 73 of the current extraction branch 68 and drain terminal connected to the second node 75 of the current extraction branch 68 and conducts a current $I_{RES}$.

Due to the symmetry between the converter branch 44 and the current extraction branch 68, clear from FIG. 4 (the PMOS transistors 46 and 70 are connected and biased in the same way, as are the cascode transistors 48, 71 and the NMOS transistors 50, 72), the PMOS transistors 46 and 70 and the cascode transistors 48, 71 are flowed by currents with the same value, just as the NMOS transistors 50,72 are flowed by currents with the same value (sum of the currents supplied to the input node 54, respectively to the second node 75). Consequently, the input current $I_A$ supplied by the first resistor 56 (current drawn by the first current input 31*a* of the operational transimpedance amplifier 31) is equal to the current $I_{RES}$ supplied by the current extraction transistor 74.

Figure 5:
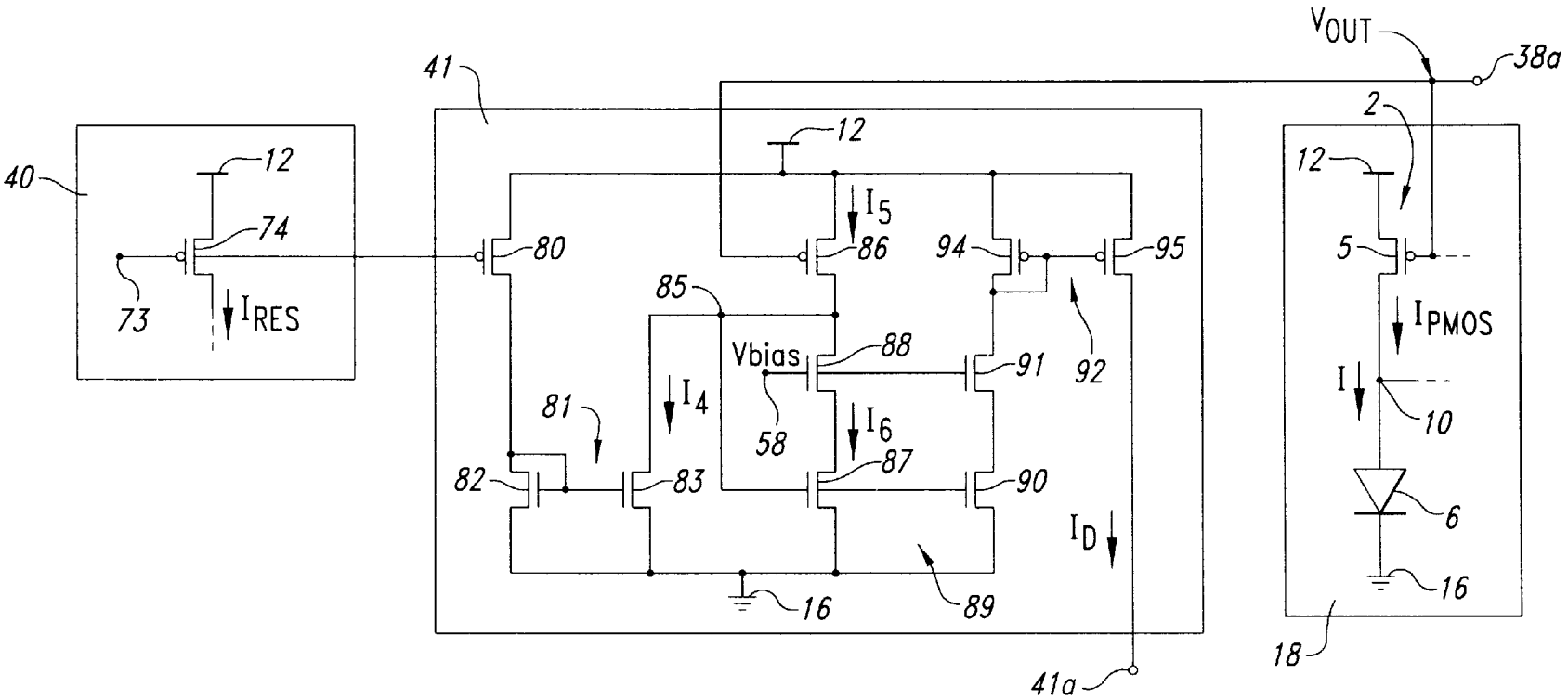

The structure of the diode current extraction stage 41 is shown in FIG. 5, wherein, to simplify the understanding of its operation, the current extraction transistor 74 of the amplifier current extraction block 40 and the first branch 2 of the bandgap stage 18 have been reproduced.

In detail, the diode current extraction stage 41 comprises a mirror transistor 80, of PMOS type, having an identical structure to the current extraction transistor 74 of the amplifier current extraction block 40. The mirror transistor 80 has gate terminal connected to the node 73 of the amplifier current extraction block 40, source terminal connected to the supply line 12 and drain terminal connected to a NMOS mirror 81 formed by an input mirror transistor 82 and an output mirror transistor 83. The output mirror transistor 83 has drain terminal connected to a current sum node 85 connected to the drain terminals of a PMOS transistor 86 and of a NMOS transistor 88.

The PMOS transistor 86 of the diode current extraction stage 41 is identical to the first PMOS transistor 5 of the first branch 2 and has a source terminal connected to the supply line 12 and gate terminal connected to an output of the differential amplifier 38; it also conducts a current $I_5$. The NMOS transistor 87 has source terminal connected to ground 16, drain terminal connected to the source terminal of a cascoded transistor 88 of NMOS type, and gate terminal connected to current sum node 85. The cascoded transistor 88 has a gate terminal connected to the bias node 58, drain terminal connected to the current sum node 85, and conducts a current $I_6$. The NMOS transistor 87 and the cascoded transistor 88 form a cascoded current mirror 89 with a NMOS transistor 90 and a cascoded transistor 91, of NMOS type; in detail, the NMOS transistor 90 has a source terminal connected to ground 16, gate terminal connected to the current sum node 85 and drain terminal connected to the source terminal of the cascoded transistor 91; the latter has gate terminal connected to the bias node 58 and drain terminal connected to a PMOS current mirror 92 formed by an input transistor 94 and an output transistor 95. The output transistor 95 has a drain terminal forming the output 41*a* of the diode current extraction block 41 and supplying the current $I_D$.

Since the mirror transistor 80 is identical and has the same gate-source voltage as the current extraction transistor 74, it conducts a current equal to $I_{RES}$, just as the input mirror transistor 82 and the output mirror transistor 83.

Consequently $I_{RES}=I_4$. Moreover, since the PMOS transistor 86 of the diode current extraction block 41 is identical and has the same gate-source voltage as the first PMOS transistor 5 of the first branch 2, it conducts a current $I_5=I_{PMOS}$. The NMOS transistor 87 of the cascoded current mirror 89 is therefore supplied with a current $I_6$ equal to the difference between the current $I_5$ and the current $I_4$, that is:

$$I_6=I_5-I_4=I_{PMOS}-I_{RES}=I_{PMOS}-I_A=I \quad (3)$$

Thanks to the cascoded current mirror 89 and to the PMOS current mirror 92, this current is supplied to the output 41*a* of the diode current extraction block 41, hence $I_D=I$.

Thereby, the output current of the diode current extraction block 41 is equal to the current flowing in the first diode 6 of the bandgap stage 18, so it is proportional to $V_T/R_1$.

Figure 6:
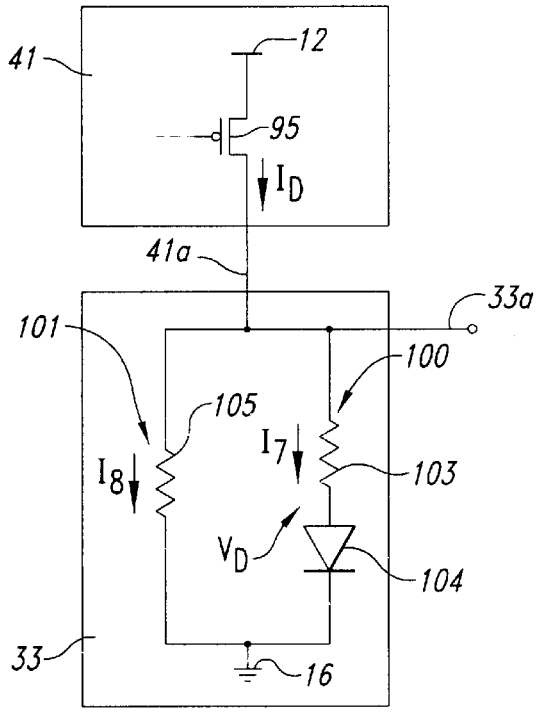

The structure of the output stage 33 is shown in FIG. 6, wherein, to simplify the understanding of its operation, the output transistor 95 of the PMOS current mirror 92 has been reproduced.

In detail, the output stage 33 comprises a first and a second output branch 100, 101 parallel-connected between the output 41*a* of the diode current extraction block 41 and ground 16. In detail, the first output branch 100 comprises a first output resistor 103 and an output diode 104 series-connected, with the cathode of the diode connected to ground 16, and the second output branch comprises a second output resistor 105. The output resistors 103, 105 have a resistance $R_3$, respectively $R_4$, and are formed using the same technology. The voltage across the output branches 100, 101 represents the desired bandgap voltage $V_{BG}$.

By defining as $V_D$ the voltage across the output diode 104, $I_7$ the current flowing in the first output branch 100 and $I_8$ the current flowing in the second output branch 101, we have:

$$V_{BG}=R_4{}^*I_8$$

From which, with simple calculations, we obtain that:

$$V_{BG} = [I * R_4 * R_3 / (R_3 + R_4)] + [V_D * R_4 / (R_3 + R_4)] = \quad (4)$$

$$= \frac{V_T \ln(n)}{R_1} \frac{R_4 R_3}{(R_3 + R_4)} + \frac{V_D R_4}{R_3 + R_4}$$

Practically, the output stage 33, with respect to the known output stage 18 of FIG. 1, has a parallel resistor (second output resistor 105) that divides the current supplied to the output stage 33 and reduces the voltage across the first output resistor 103. This solution allows the reduction of the bandgap voltage $V_{BG}$ to 840 mV, without affecting temperature compensation. In fact, the temperature coefficient of the first resistor 8 of the bandgap stage 18, and the first and second output resistors 103, 105 are equal to and compensate each other, and the variations due to the term $V_T$ and to $V_D$ may be compensated as in the known circuit.

Figure 7:
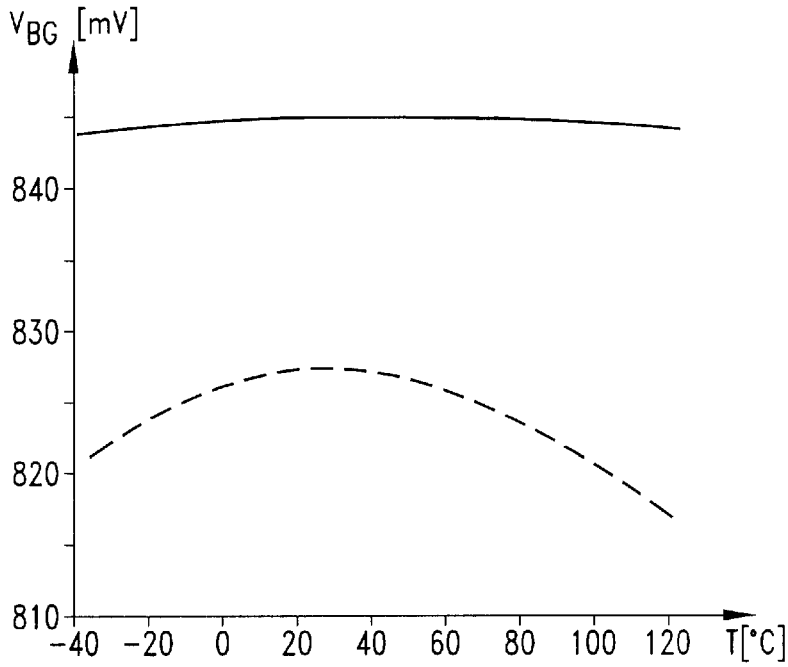
FIGS. 7 and 8 show comparative characteristics of the reference source according to the invention and of a known source.

The advantages of the described source are as follows. First, it is able to supply an output regulated voltage even with supply voltages with a lower value than that which can be used with known circuits (on the basis of the simulations carried out, the present source works correctly even with a supply voltage of 1 V). On this point see FIG. 7 which shows the temperature trend of the bandgap voltage $V_{BG}$ with a supply voltage of 1.2 V, shown with a continuous line for the source according to the invention and with a dashed line for a NMOS source working below the threshold using the output stage 33 to reduce the output voltage. As may be seen, the reference source according to the invention has a voltage variation of only 2.5 mV in the interval between −40° C. and 125° C., while the known source has a voltage variation of 12 mV.

Moreover, the described source uses only components that can be formed with standard HCMOS technology (High Speed CMOS) and may therefore also be implemented in many CMOS processes.

The supply consumption is controlled in all conditions and limited to low values irrespective of the supply voltage (for example, indicatively, in the simulations carried out by the applicant it was 4 $\mu$A).

The source is able to supply a current component with a negative slope, which may be used as part of a current reference.

The activation time of the source is limited (typically to 70 ns) in all conditions.

Figure 8:
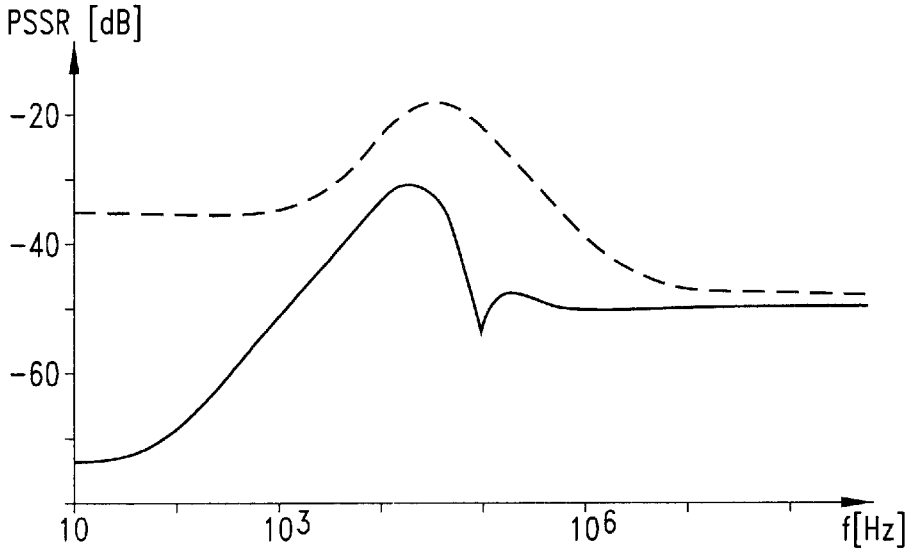

Moreover, the described reference source has good behavior with respect to the rejection of disturbances in DC, as shown in FIG. 8 showing with a continuous line the plot that may be obtained with the present reference source and with a dashed line the plot that may be obtained with the known source with NMOS working below the threshold. As may be seen, the PSRR is considerably improved, in particular in DC; in fact there is about 74 dB DC and a peak of about 30 dB at 20 kHz.

Finally, the described reference source has a good frequency stability, with a phase margin of about 80°.

Lastly it is clear that numerous modifications and variations of the reference source described and illustrated herein may be made, all falling within the scope of the invention, as defined in the annexed claims.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A bandgap type reference voltage source, comprising:

a bandgap stage having a first and a second output node and a control input, said bandgap stage comprising first and second bandgap branches, parallel-connected, said first bandgap branch comprising a first diode element and a first control element series-connected and forming, at a connection between the first diode element and the first control element, said first output node, said second bandgap branch comprising a second diode element and a second control element series-connected and forming, at a connection between the second diode element and the second control element, said second output node;

an operational transimpedance amplifier having inputs connected to said output nodes of said bandgap stage and an output connected to the control input of said bandgap stage, said operational transimpedance amplifier comprising a first and second current input connected to said first and said second output nodes of said bandgap stage, respectively, and a first and a second output terminal;

an amplifier current detecting stage connected to said first and second output terminals of said operational transimpedance amplifier and having an output supplying a first quantity related to a current flowing in said first current input of said operational transimpedance amplifier; and a diode current detecting stage having a first input connected to said output of said current detecting stage, a second input connected to said second output terminal of said operational transimpedance amplifier and having an output supplying a second quantity related to a current flowing in said first diode element.

2. A source as claimed in claim 1, wherein said operational transimpedance amplifier comprises a current/voltage converter circuit and a differential circuit, cascade-connected.

3. A source as claimed in claim 2, wherein:

said current/voltage converter circuit comprises first and second conversion branches parallel-connected and each having an input node connected to a respective current input through a respective resistive element; and wherein said amplifier current detecting stage comprises a converter replica branch having a same structure as said first and second conversion branches and defining an input replica node symmetrical to said input node of said first conversion branch and connected to an input current detecting element passed by a replica current equal to said current flowing in said first current input of said operational transimpedance amplifier.

4. A source as claimed in claim 3, wherein:

said first conversion branch comprises a load transistor element, a bias transistor element and an input transistor element series-connected, said bias transistor element and said input transistor element forming said input node of said first conversion branch; and said input current detecting element comprises a load transistor replica element, a bias transistor replica element and an input transistor replica element, series-connected to each other, said bias transistor replica element and input transistor replica element forming said input replica node;

said load transistor element and load transistor replica element each has a control input connected to said second output terminal of said operational transimpedance amplifier;

said bias transistor element and bias transistor replica element each has a control input connected to each other;

said input transistor element and input transistor replica element each has a control input connected to each other, to said first output terminal of said operational transimpedance amplifier and to an intermediate node between said load transistor and bias transistor elements; and said input current detecting element comprises a transistor element having a control terminal connected to an intermediate node between said load and bias transistor elements and a conduction terminal connected to said input replica node.

5. A source as claimed in claim 3, wherein:

said diode current detecting stage comprises a control current detecting element detecting a current flowing in said control element of said first bandgap branch;

a subtracting node, connected to said control current detecting element and said input current detecting element and an output element receiving a current equal to the difference between said current flowing in said control element and said replica current.

6. A source as claimed in claim 1, further comprising an output stage comprising a first and a second output branch parallel-connected between said output of said diode current detecting stage and a reference potential line, said first output branch comprising a first output resistor and a diode element, series-connected, and said second output branch comprising a second output resistor.

7. A device, comprising:

a bandgap current source having a control terminal and first and second branches, configured to generate first and second upper branch currents, respectively, the first branch including upper and lower branches connected at a first output node to a first output line such that the first upper branch current is divided into a first lower branch current in the first lower branch and a first output current in the first output line, and the second branch including upper and lower branches connected at a second output node to a second output line such that the second upper branch current is divided into a second lower branch current in the second lower branch and a second output current in the second output line;

means for converting the first and second output currents to first and second voltages, respectively;

a differential amplifier having first and second inputs coupled to the first and second voltages, respectively, and an output coupled to the control terminal of the bandgap current source;

means for generating a third current, equal to the first lower branch current; and means for converting the third current to a bandgap voltage.

8. The device of claim 7 wherein the means for generating the third current comprises:

means for generating a fourth current, equal to the first upper branch current;

means for drawing from the fourth current a fifth current, equal to the first current, leaving the third current, equal to the first lower branch current.

9. A method, comprising:

generating a branch current in a bandgap current source circuit;

dividing the branch current into an output current and a lower branch current;

controlling the branch current against fluctuations caused by temperature changes;

generating a first duplicate current, equal to the lower branch current, in an output circuit; and generating a bandgap voltage from the duplicate current.

10. The method of claim 9 wherein the generating the duplicate current step comprises:

generating a second duplicate current, equal to the branch current; and dividing the second duplicate current into a third duplicate current, equal to the output current, and the first duplicate current.

11. The method of claim 9 wherein the controlling step comprises:

generating an additional branch current in the bandgap current source circuit;

dividing the additional branch current into an additional output current and an additional lower branch current;

comparing the output current and the additional output current; and adjusting the branch current and the additional branch current according to differences, measured in the comparing step, caused by temperature fluctuations.

* * * * *

UNITED STATES PATENT AND TRADEMARK OFFICE

CERTIFICATE OF CORRECTION

PATENT NO. : 6,680,643 B2
DATED : January 20, 2004
INVENTOR(S) : Antonino Conte et al.

It is certified that error appears in the above-identified patent and that said Letters Patent is hereby corrected as shown below:

Column 8,
Line 40, "and second current" should read as -- and a second current --
Line 51, "of said current" should read as -- of said amplifier current --.

Signed and Sealed this

Fifteenth Day of June, 2004

JON W. DUDAS
*Acting Director of the United States Patent and Trademark Office*